United States Patent [19]

Takahashi

[11] 4,137,691

[45] Feb. 6, 1979

[54] PACKAGING MACHINE

[75] Inventor: Shizuo Takahashi, Abiko, Japan

[73] Assignee: Tokyo Automatic Machinery Works, Ltd., Tokyo, Japan

[21] Appl. No.: 770,981

[22] Filed: Feb. 22, 1977

[30] Foreign Application Priority Data

Mar. 2, 1976 [JP] Japan ..... 51-23008
Mar. 2, 1976 [JP] Japan ..... 51-3706
Mar. 2, 1976 [JP] Japan ..... 51-3707

[51] Int. Cl.[2] ..... B65B 11/16; B65B 11/22

[52] U.S. Cl. ..... 53/229; 53/226; 53/230

[58] Field of Search ..... 53/228, 229, 230, 231, 53/182 R, 182 M, 210, 226; 156/515

[56] References Cited

U.S. PATENT DOCUMENTS 3,537,235 11/1970 Pepmeier et al. ..... 53/210 X
3,662,513 5/1972 Fabbri ..... 53/226 X
3,672,116 6/1972 Ingmarson ..... 53/229 X
3,977,158 8/1976 Jennings et al. ..... 53/226

*Primary Examiner*—Travis S. McGehee
*Attorney, Agent, or Firm*—McCormick, Paulding & Huber

[57] ABSTRACT

A stretch wrap packaging machine packages articles received on trays, and can handle various different article geometries and tray sizes without modification. In an initial phase of a wrapping operation film is sleeve wrapped around an article and tray by elevating the article and tray upwardly against a horizontally stretched length of film to draw the film over the article and tray and downwardly along and beyond both ends of the article and tray, and by then joining the downwardly extending film portions below the tray and cutting them from the film supply through the use of a heat-seal and cut-off device having a heated wire which supplies heat to the film, to perform the heat-seal and cut-off functions, by radiation and without engaging the film.

18 Claims, 11 Drawing Figures

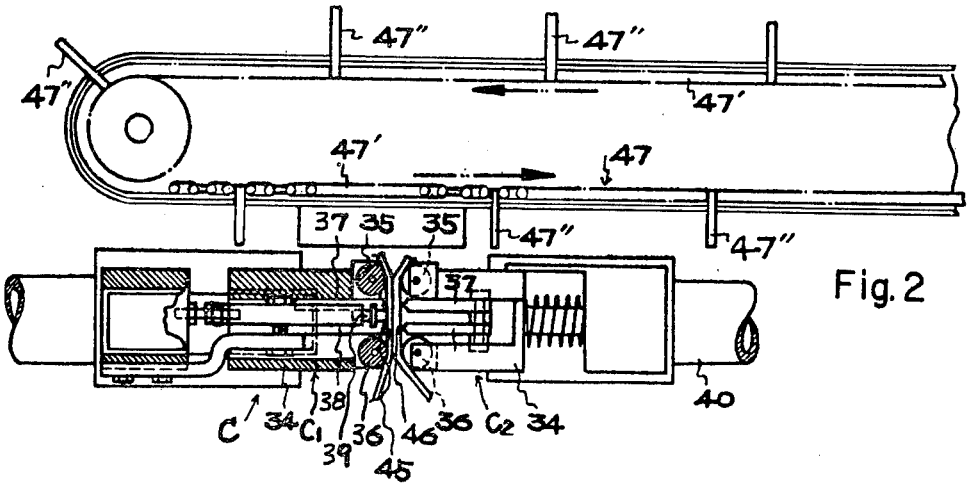
Fig. 2
Fig. 3
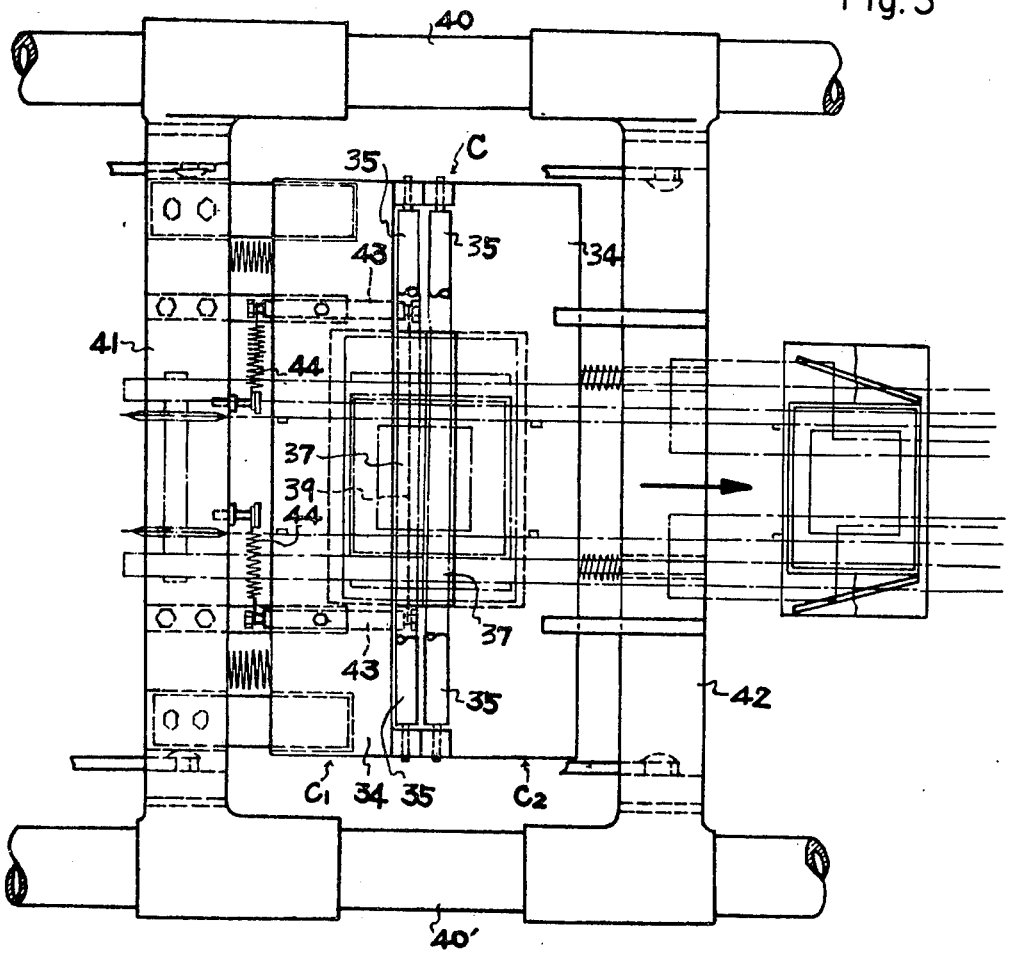

54
F
35
a
46
35
37
C2
34
C'
37
59
22
45
23
36
52
31
31
22
38
28
28
29
27
29
27
30
21
33
30
B
20
17
18

F
54
a
C1
37
35
35
37
C2
34
34
39
22
22
38
36
36
F
38
F
21
B
20 a
22
23
22
33
28
6
28
B
21
20

54
C
F
a
35
C1
37
35
37
C2
34
34
38
38
39
36
36
F
17
F
55
55
F
18
22
22
23
28
6
28
B
33
21
20

31
22
28
32
23
21
22
27
33
31
27
27
28
27
22
23
28
33
22
27
22
28
32
27
22
31

34
35
45
46
35
37
34
C2
45
40
46
36
38
C'
43
C1
36

PACKAGING MACHINE

BACKGROUND OF THE INVENTION

This invention relates to a machine for packaging articles, and deals more particularly with such a machine wherein articles are packaged by means of a stretchable film stretched around the articles and sealed to itself.

An object of the present invention is to provide an improved packaging machine in which a packaging operation can be performed mechanically and automatically independently of the size of trays on which articles to be wrapped are rested and of the geometry of the articles.

Another object of the invention is to provide a packaging machine of the aforesaid character for providing packages wherein the sealed part of each package is firmly and finely finished, and which machine furthermore emits little or no smoke or gas when the film applied around an article is heat sealed during the packaging of the article.

Other objects and advantages of the invention will become apparent upon reading the following detailed description and upon referring to the drawings forming a part hereof.

BRIEF DESCRIPTION OF THE DRAWINGS

FIG. 2 is an enlarged fragmentary elevational view partly broken, of the heat-sealing and cut-off device of the packaging machine of FIG. 1, the device being shown in its closed condition.

FIG. 3 is a plan view of the heat-sealing and cut-off device shown in FIG. 2.

DETAILED DESCRIPTION OF THE PREFERRED EMBODIMENT

While the invention is described herein in connection with a preferred embodiment, it should be understood that there is no intention to limit the invention to that embodiment. On the contrary, the intention is to cover all alternatives, modifications and equivalents as may be included within the spirit and scope of the invention as defined by the appended claims.

Figure 1:
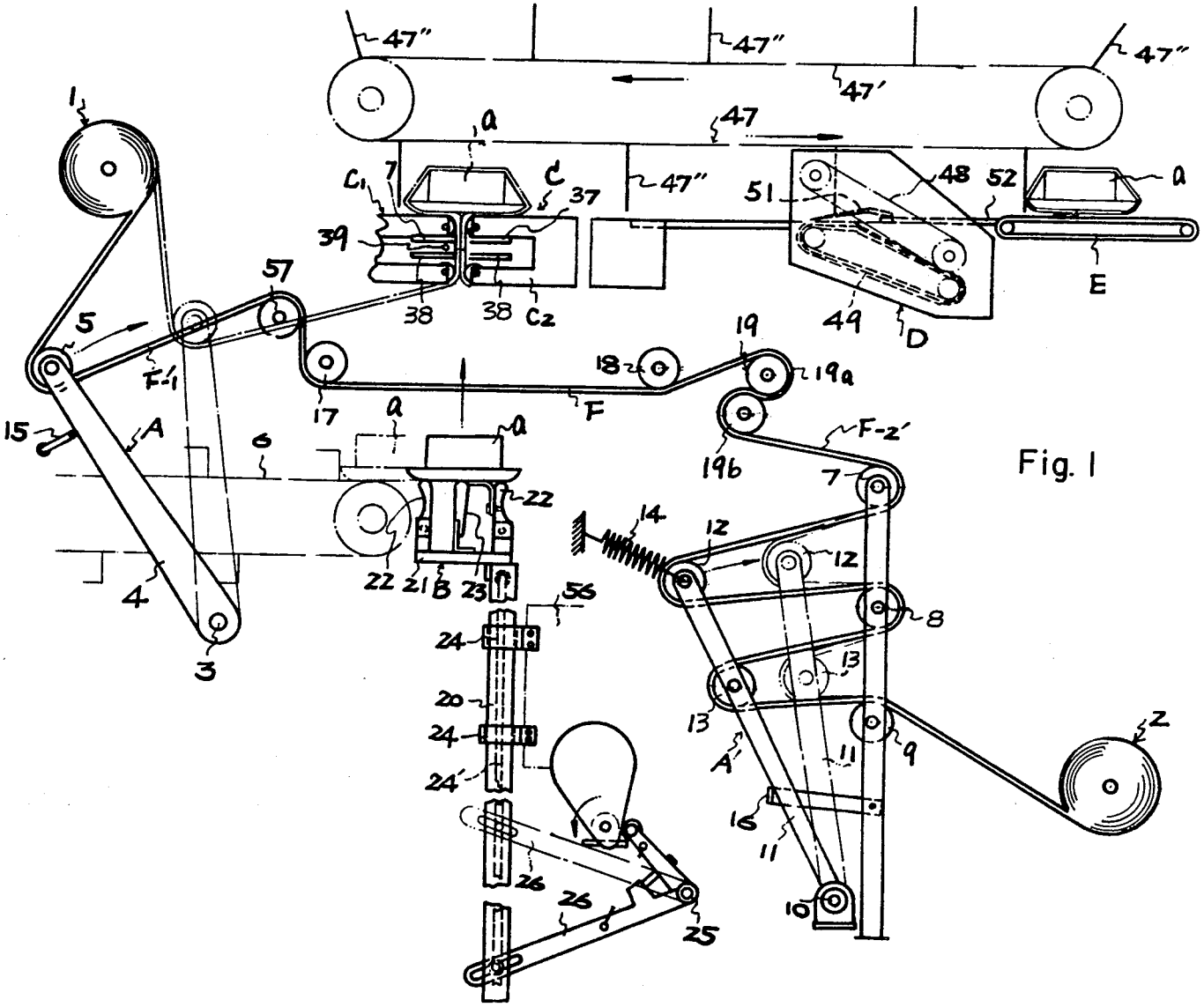
FIG. 1 is a fragmentary elevational view, somewhat schematic, of a packaging machine embodying the invention.
Figure 5:
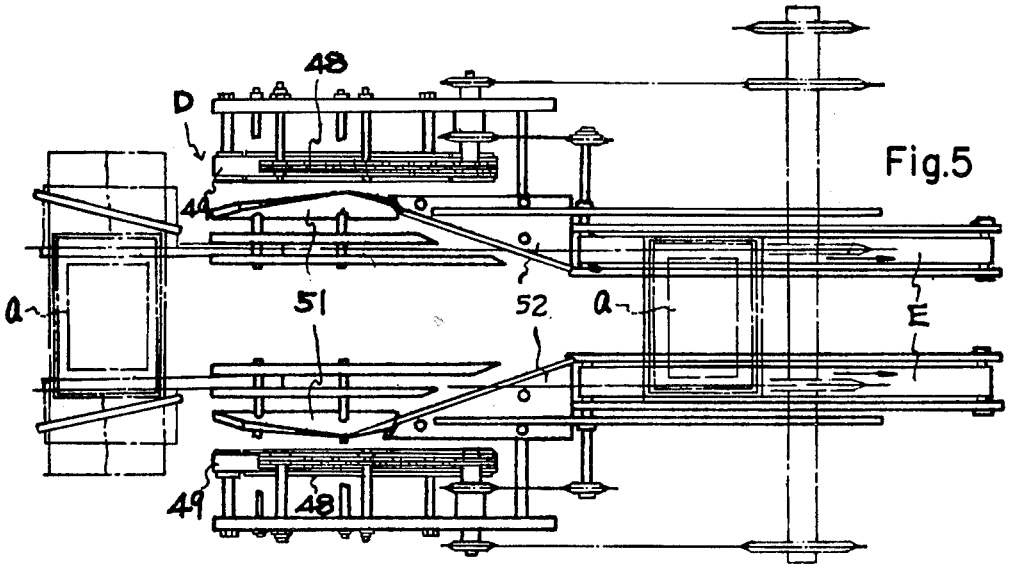
FIG. 5 is a plan view of the pinching device illustrated in FIG. 4.

Turning now to the drawings, FIG. 1 shows a packaging machine with which the present invention is associated. The packaging machine includes film supply rolls 1 and 2 which are rotatably supported by the machine frame in a properly spaced relation to each other. Associated with each supply roll is a tension device A or A′ located at the corresponding side of an elevator B which permit the length of film necessary for the wrapping of an article to be automatically unwound under tension.

The tension device A, associated with the supply roll 1, includes a pair of arms 4, supported for pivotal movement by the shaft 3, and a roller 5 journalled on a shaft at the upper ends of the arms. The said arms 4, which rotatably carry the transverse roller 5, are positioned on opposite sides of an infeed conveyor 6 carrying the articles a to be packaged to the elevator B, so that rotation of the arms 4 through a fixed angle causes the film length necessary to package an article a to be drawn from the film roll 1.

The tension device A′, associated with the supply roll 2, includes rollers 7, 8 and 9 supported rotatably by the machine frame, in vertically spaced relation to one another, and rollers 12 and 13 which are rotatably carried by an arm 11 in vertically spaced relation to one another and which function to draw the film a predetermined length of film from the film roll 2. To ensure that the members are restored again to their original position after the film is drawn, a tension spring 14 is disposed between the upper end of the arm 11 and the machine frame.

Further, the arms 4 of the tension device A and the arm 11 of the tension device A′, as described above, start moving in response to the incoming of an article a to be wrapped from the infeed conveyor 6, whereas the film unwinding operation is achieved through cooperation with cam mechanism and so on. Both 15 and 16 are stops. The former acts to restrict the rotation angle of the arm 4 of the tension device A, while the latter restricts that of the arm 11 of the tension device A′. Between side plates forming part of the machine frame are rotatably journalled guide rollers 17 and 18 on opposite sides of the elevator B in such a manner that the film F is held horizontal at the beginning of a wrapping operation. Between the guide roller 18 and the roller 7 in the tension device A′ is positioned a film back motion preventing mechanism 19.

The film back motion preventing mechanism 19 consists of two rollers 19*a* and 19*b* arranged in vertical opposite relation to each other, and is constructed so that the lower roller 19*b* contains a clutch means (not shown) which allows the roller 19*b* to rotate in the film forward direction but not in the film backward direction. It will thus be understood that the film F-1′ unwound from the film roll 1 is threaded on the roller 5 of the tension device A and extends over an auxiliary roller 57 and then over a guide roller 17. The film F-2′ unwound from the film roll 2 is threaded on rollers 9, 13, 8, 12 and 7 included in the tension device A′, so as to form a zigzag configuration, and extends over the rollers 19*a* and 19*b* of the film back preventing mechanism 19, and then over the guide roller 18. These films F-1′ and F-2′ are sealed together between the rollers 17 and 18 so as to make an integral or continuous film F.

The elevator device B includes a supporting arm 20, a base 21 secured to the upper end of the supporting arm, rocking upright arms 22 mounted on the upper surface of the base 21, and supporting or carrying arms 23. The supporting arm 20 is connected to a machine frame 56 for slidable vertical movement by guides 24. At the upper part of the supporting arm 20 a rod 24′ is pivotally connected to it, and at its lower end the rod 24' is pivotally connected to an operating arm 26 which rotates pivotally around the axis of the shaft 25, so that vertical pivotal movement of the arm 26 causes the supporting arm 20 to move vertically along the guides (see FIG. 1) 24 in cooperation with the rod 24'.

The rocking arms 22 are disposed at the sides of the base 21 and are mounted on the base 21 for rotational movement by means of bearings 27 and pins 28. At the lower end of each one of the said rocking arms 22 a spring mounting member 29 is secured, and a spring 31 is spanned from each spring mounting member 29 to an upright screw 30 mounted on the base 21 so that the rocking arms 22 are restored to their original conditions automatically by the tension of the springs 31.

Stops 32 stop the rocking arms 22 at vertical positions in the course of their return movement. Also, the rocking arms 22 mentioned above preferably are mounted in upright positions at both (right and left) sides of the base 21, and between the said rocking arms 22 at the both sides of the base the supporting arms 23 are positioned.

Figure 8:
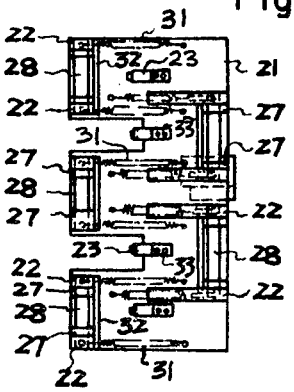
FIG. 8 is a plan view of the elevator device of the packaging machine of FIG. 1.

The supporting arms 23 are carried on the base 21 in vertical positions by means of L-shaped elastic members 33 with cushioning property so that when external forces are applied to the supporting arms 23, spring action by the elastic members 33 permits the arms 23 to move in both (right and left in FIG. 8) direction. Therefore, the article to be wrapped, which is fed to the elevator by the infeed conveyor 6, is carried by different arms depending on its physical dimension. That is, when the article is carried by a tray and the tray is large in size, the tray is carried on the rocking arms 22, and on the carrying arms 23 disposed upright between the said arms 22, at both (right and left in FIG. 1) sides of the base. When the tray is small in size, it is carried on the rocking arms 22 adjacent to the infeed conveyor 6 and on the supporting arms 23. This ensures that all articles to be wrapped are securely carried on the elevator B regardless of size.

In addition, vertical movement of the elevator B can be obtained in such a way that it occurs only when an article a to be wrapped is passed above a microswitch (not shown) arranged near to the position at which the article is put on the elevator by the infeed conveyor, which prevents the horizontally extended film F from being pushed up by the elevator B with no article a on it.

With the elevator B thus arranged, an article a carried by it is pushed up into engagement with the horizontally extended film F positioned over the elevator B. Further upward movement of the elevator causes the film to cover the top surface of the article a, and positions the article a above a heat-sealing and cut-off device c.

Figure 9:
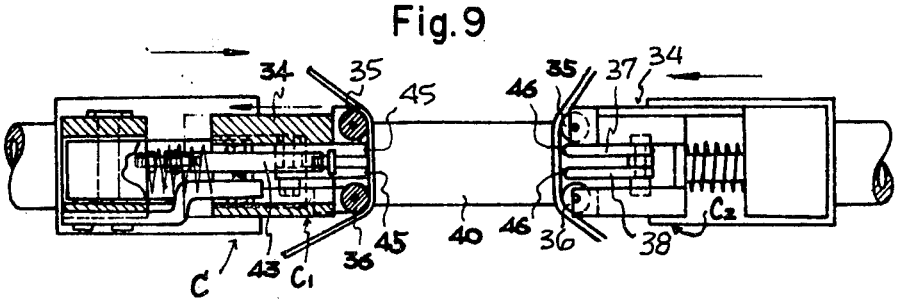
FIG. 9 is an elevational view, partly broken, of the heat-sealing and cut-off device of the packaging machine of FIG. 1, this view being generally similar to FIG. 2 except for showing the device in its open condition.

The heat-sealing and cut-off device c, as shown in FIGS. 2, 3 and 9, includes two frames 34, a transverse upper roller 35 and a lower roller 36 located in position at the front of each frame 34 in vertical spaced relation to each other, and two pinching members c1 and c2 each having a pair of film carriers 37 and 38 between its upper and lower rollers 35 and 36. Either one of the pinching members c1 and c2 (in the illustrated case the member c1) is provided with a heating wire 39 located between its film carriers 37 and 38. Also, the pinching members c1 and c2 are respectively mounted slidably on frames 41 and 42 slidably carried by guide rods 40 and 40'. Closing movement of both sliding frames 41 and 42 causes the film portions located therebetween and extending downwardly from both sides of the article to be folded inwardly.

Supports 43 carrying the heating wire 39 are separate from the frame 34 and are carried by the frame 41 so that sliding travel of the frame 34 relative to the frame 41 during closing movement of the frames 41 and 42 causes the wire 39 to approach the film surface and to heat-seal and cut the film by means of radiation heat produced by the heating wire 39. Coil springs 44 serve to keep the heating wire 39 under tension, the supports 43 being pviotally supported intermediate their ends.

Moreover, the tips of both film carriers 37 and 38 of the pinching member c1 are provided with grooves 45, while those of the pinching member c2 are provided with protrusions 46 that mate with the grooves when the members c1 and c2 are abutted against each other, which prevents the film between the film carriers 37 and 38 of pinching member c1 and the film carriers 37 and 38 of the pinching member c2 from shifting. Thus, this arrangement allows the film wrapped around the upper and side surfaces of the article a to be cut-off and heat-sealed through radiation heat from the heating wire 39 while the film is kept pinched, forming a sleeve around the article a.

A transfer device 47 wherein pushing members 47" are secured to a chain 47' in an appropriate spaced relation to one another, functions to deliver the sleeve wrapped article a into a pinching device D by means of the pushing members 47".

Figure 4:
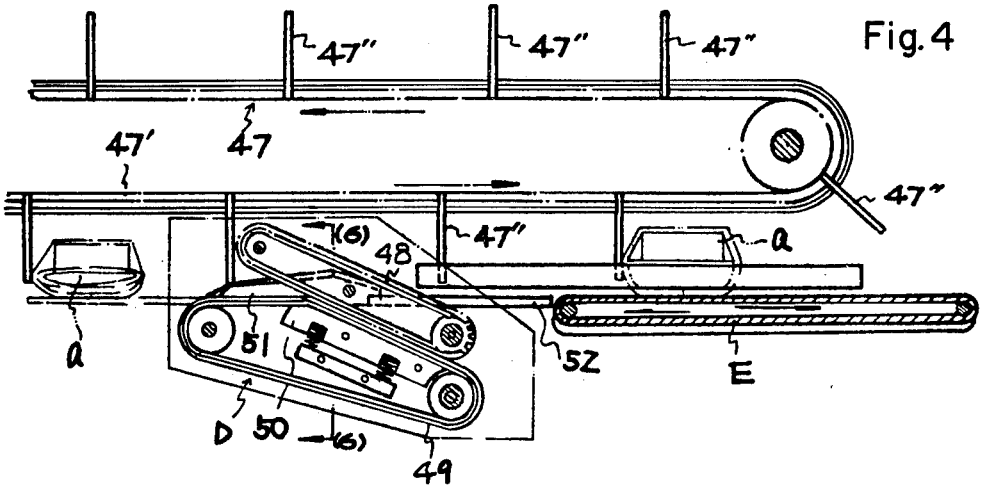
FIG. 4 is an enlarged, fragmentary elevational view partly broken, of the pinching device of the packaging machine of FIG. 1.
Figure 6:
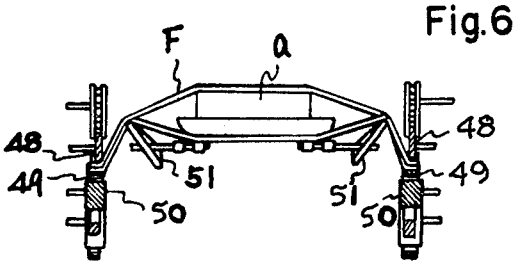
FIG. 6 is a fragmentary section taken substantially along the line 6—6 of FIG. 4.

The pinching device D includes chains 48 and belts 49 progressively descending with respect to flow direction of the article a and the belts 49 are held pressed against the chain 48 by pressing members 50 as shown in FIG. 4. The slanted plates 51 (refer to FIG. 1) serve to help pull both sides of the film sandwiched in between the chains 48 and belts 49 outwards. Folders 52 are located at the front of the slanted plates 51 so that the both open sides of the sleeved film which has been elongated while it passes through the slant plates 51, are folded down and applied to the bottom of the article as they pass through the folders 52 which are formed so as to decrease progressively the clearance between the folders 52 along the direction that the article a proceeds.

A device E is a known type of heat-sealing conveyor for heat-sealing the folded down portion of the film and for discharging the heat-sealed article.

However, the pinching device D mentioned above is positioned further into the middle of the folders 52 so that the article can be transferred to the folders 52 with the film being pinched. A pusher 54 interrupts upward movement of the article a when it is sleeve-wrapped and the film is cut off.

Figure 7A:
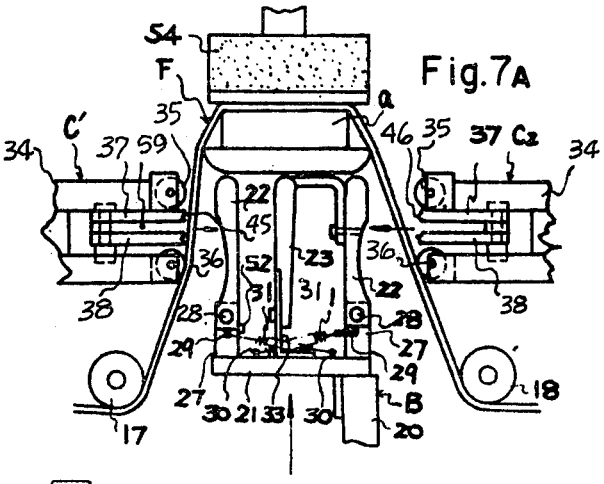
FIGS. 7*a*, 7*b* and 7*c* are fragmentary elevational views showing successive steps performed by the machine of FIG. 1 in sleeve wrapping an article and tray.
Figure 7B:
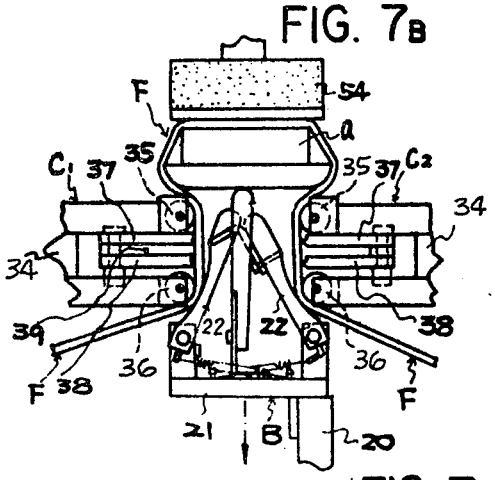
Figure 7C:
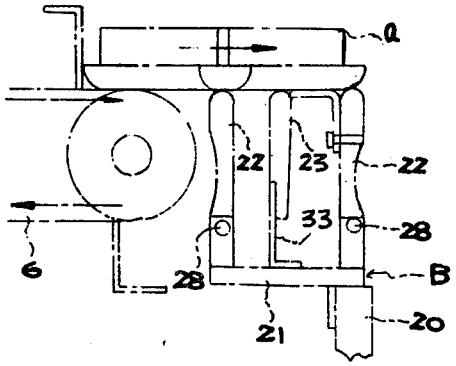
Figure 7C:
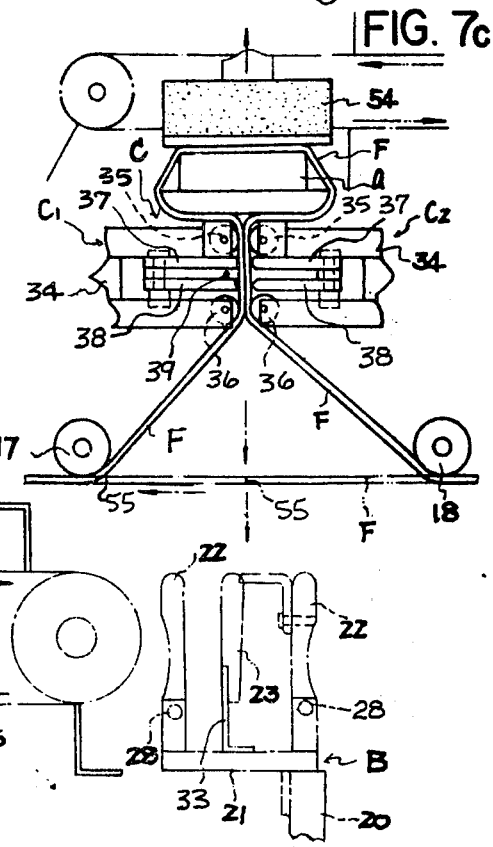

In the operation of the above-described packaging machine, first the article a fed to the infeed conveyor 6 manually or automatically is carried forwardly by means of the infeed conveyor driven through a suitable power source (not shown), and placed on top of the rocking arms 22 and supporting arms 23 of the elevator B. Here, the article to be wrapped a actuates a microswitch (not shown) provided at the downstream end of the infeed conveyor, causing the elevator now carrying the article to initiate its upward movement until the said article abuts against the horizontally extended film F over the elevator, and continued upward movement of the elevator, in turn, causes the article to be passed between the pinching members c1 and c2 (which form the heat-sealing and cut-off device c) with the top surface of the article covered by the film. When the elevator B is in its raised position, as it appears in FIG. 7*a*, the arms 22 and 23 are in upright positions and in the path of the pinching members c1 and c2 which are supported for lateral movement into and out of pinching relation with each other.

In response to the upward travel of the elevator B, the pinching members c1 and c2 of the heat-sealing and cut-off device c slide laterally inwardly toward one another to pinch and lap the film for packaging the article a, and simultaneously the radiation heat from the heating wire associated with the pinching member c1 cuts-off and heat-seals the lapped part of the film, forming a sleeve around the article a. As the pinching member c1 and c2 move inwardly toward pinching relation the rocking arms 22, 22 pivot laterally inwardly from upright positions in response to the laterally inwardly directed force applied to the rocking arms by the pinching members. Since the various arms 22 and 23 are out of lateral alignment with each other the upper free end portions of the arms are freely movable past each other as shown in FIG. *7b*. As the pinching members c1 and c2 approach each other the weight of the article a is transferred from the elevator B to the pinching members c1 and c2. Thereafter, and before the pinching members move into pinching relation, as shown in FIG. *7c*, the elevator B is lowered to its article receiving position wherein the upper ends of the arms 22 and 23 are aligned with the infeed conveyor 6.

During the heat-sealing and cutting-off operation, a pusher 54 is lowered to press the article a for smooth cutting-off and heat-sealing operation.

The article a thus sleeve wrapped is pushed into the pinching device D by the pushing members 47" of the transfer device 47.

Since the article a transferred into the pinching device D is passed through the slanted plates 51 inclined outwards and upwards along the flow direction with both open ends of the sleeved film sandwiched in between a chain 48 and a belt 49, both of which are inclined downwards along the flow direction, the both ends of the sleeved film are pulled outwards. Then while being pulled outwards they are passed between the folders 52, which are so arranged that the clearance between them becomes smaller as the article a proceeds forwards, then they are folded down to the bottom of the article a, and thereafter they are heat-sealed at the folded portion, completing packaging operation.

In the aforementioned packaging process, the heat-sealing and cut-off device c is arranged so that when the film formed into a sleeve around the article a by means of the heat-sealing and cut-off device c is cut-off from the extended films F-1' and F-2', the films F-1' and F-2' are also heat-sealed to one another to form one jointed film. The sealed part 55 of the jointed film is moved toward the tension device A by means of the latter's operation to assure that during the subsequent packaging operation the sealed part 55 is located neither at the upper nor the side surface of the article a but at the bottom of it.

Pursuant to the present invention, an automatic stretch packaging operation can be achieved regardless of the geometry of the article to be wrapped or of the size of the tray on which it is carried.

Furthermore, this invention is characterized in that during the cutting-off operation, because the pinching members pinch the film securely and during this pinching the heating wire approaches the lapped films to heat-seal and cut-off the films by means of radiation heat, emission of bad smell (gas) or smoke can be avoided, the sealed part is finished firmly and finely, and the cutting-off capability of the heating wire can be maintained for an extended period.

Conventional cutting-off practices have provided various disadvantages such as emission of gas at the time of cutting-off the film, generation of burnt off traces at the cut-off part, and adherence of burnt-off debris of the film to the heating wire, resulting in a decreased cutting-off capability of the heating wire in service for an extended period, because the conventional practices have the heating wire directly touching the film to cut it off. These disadvantages are eliminated substantially by the improved packaging machine according to this invention. Thus, this invention offers a packaging machine that enhances product value.

I claim:

1. A packaging machine comprising tension means for delivering stretchable strip films under proper tension, an elevator means having supporting upright arms for pushing up an article to be wrapped from the bottom into engagement with film positioned horizontally by means of said tension means to wrap the upper surface of the article and form two downwardly extending film portions at opposite ends of the article, a heat sealing and cutting means for folding said two downwardly extending film portions toward one another below said article to form a sleeve and for heat-sealing said film portions to one another and cutting them from the remainder of the film supplied by said tension means by means of radiation heat from a heater, a pinching means for pinching and pulling the both open sides of said sleeve to fold them down to the bottom of said article, and a heat sealing means for heat-sealing the so folded sides of said sleeves.

2. A packaging machine as set forth in claim 1 wherein at least one of said arms is supported for movement relative to the other of said arms.

3. A packaging machine as set forth in claim 1 wherein said upright arms have upper end portions disposed in a common generally horizontal plane when said arms are in upright position and said one arm is supported below its upper end for rocking movement to and from its upright position.

4. A packaging machine as set forth in claim 3 wherein said elevator means includes means for normally biasing said one arm to its upright position.

5. A packaging machine as set forth in claim 1 wherein each of said arms is supported for movement to and from an upright position and said elevator means includes means for biasing each of said arms to its upright position.

6. A packaging machine as set forth in claim 1 wherein said heat-sealing and cutting means comprises opposing roll means receiving said downwardly extending film portions therebetween and supported for movement toward each other for folding said downwardly extending portions toward one another, opposing film carrier means receiving said film portions therebetween and supported for movement toward each other for pinching and holding the folded and downwardly extending portions therebetween, and a heater supported for movement toward said film portions held by said film carrier means for sealing and cutting said film portions by means for radiation heat.

7. A packaging machine as set forth in claim 6 wherein said heating means comprises a heating wire and means for maintaining said heating wire in tension, said heating wire being disposed generally between said film carrier means and said roll means.

8. A packaging machine as set forth in claim 6 wherein said film carrier means is supported for movement with said roll means and relative thereto and said heating means is supported for movement with said roll means and said film carrier means and for movement relative thereto.

9. A packaging machine as set forth in claim 1 wherein said pinching means includes laterally opposed pinching members supported for lateral movement into and out of pinching relation to each other and said elevator means comprises an article support assembly including said upright arms and having a base, said article support assembly including means for biasing said arms to upright positions, said arms including laterally spaced rocking arms disposed between said pinching members and in the path thereof when said elevator means is in raised position, said rocking arms being supported on said base for pivotal movement laterally inwardly from said upright positions in response to movement of said pinching members into engagement with said rocking arms and toward said pinching position when said elevator means is in said raised position, said arms including a carrying arm supported on said base between said laterally spaced rocking arms, said rocking arms being out of lateral alignment with each other and out of lateral alignment with said carrying arm, said arms having free upper end portions disposed in a generally common horizontal plane for supporting an article to be wrapped when said arms are in said upright positions, said upper end portions being freely movable past each other in response to laterally inwardly directed force applied to said rocking arms by said pinching members.

10. A packaging machine as set forth in claim 9 wherein said carrying arm is mounted on said base for resilient hinged flexure in lateral directions from its upright position in response to laterally directed force applied thereto.

11. In a packaging machine for wrapping articles in heat sealable film, a heat-sealing and cutting mechanism comprising a frame assembly including a pair of opposing frames, means supporting said frames for relative movement in a horizontal direction toward and away from each other between closed and opened positions respectively, a pair of axially parallel and vertically spaced apart rolls journalled on each of said frames, respectively, and arranged in generally opposing relation to the rolls on the other of said frames, a pair of vertically spaced apart film carriers mounted on each of said frames, respectively, between the rolls thereon and arranged in opposing relation to associated film carriers on the other of said frames, said film carriers on each of said frame being movable into pinching relation with said associated film carriers on the other of said frames, and radiant heating means supported on one of said frames between said film carriers to move relative to the other of said frames for sealing and cutting film.

12. The combination as set forth in claim 11 wherein said film carriers are supported on said frames for movement into pinching relation during movement of said frames toward said closed position and before said frames attain said closed position and said radiant heating means is supported on said one frame for continued movement therewith and toward said other frame after said film carrier attains said pinching relation.

13. The combination as set forth in claim 12 wherein said radiant heating means comprises an elongated heating wire extending in parallel relation with said rolls and means for maintaining said wire in tension.

14. The combination as set forth in claim 11 wherein movement of said rolls on one of said frames toward the rolls on the other of said frames is arrested before said film carriers move into pinching relation with each other.

15. The combination as set forth in claim 14 wherein said heating means is supported on said one frame for continued movement therewith and toward said other frame after said film carriers have moved into pinching relation to each other.

16. The combination as set forth in claim 11 wherein each one of said film carriers has a tip which generally complements the tip of an associated film carrier when said one film carrier and said associated film carrier are disposed in pinching relation with each other.

17. The combination as set forth in claim 16 wherein said tip of said one film carrier has a recess therein and said tip of said associated film carrier has a projection thereon generally complementing said recess.

18. The combination set forth in claim 11 wherein said heat-sealing and cutting mechanism includes a pair of parallel transversely spaced apart guide rods and said frames are slidably supported on said guide rods for movement between said closed and opened positions.

* * * * *